US006766219B1

(12) United States Patent
Hasey

(10) Patent No.: US 6,766,219 B1
(45) Date of Patent: Jul. 20, 2004

(54) APPARATUS FOR CONTROLLING AND MONITORING OF DISPENSING OF ORAL MEDICATIONS

(76) Inventor: Gary Marcel Hasey, 286 Kennedy Avenue, Toronto, Ontario (CA), M6P 3C3

( * ) Notice: Subject to any disclaimer, the term of this patent is extended or adjusted under 35 U.S.C. 154(b) by 0 days.

(21) Appl. No.: 09/670,299

(22) Filed: Sep. 26, 2000

Related U.S. Application Data

(62) Division of application No. 09/083,832, filed on May 22, 1998, now abandoned.

(30) Foreign Application Priority Data

May 29, 1997 (CA) ..... 2206510

(51) Int. Cl.[7] ..... G07F 17/00; G07F 7/00

(52) U.S. Cl. ..... 700/242; 700/230; 700/228; 700/238; 221/11

(58) Field of Search ..... 700/230, 228, 700/237, 242; 221/2, 3, 11

(56) References Cited

U.S. PATENT DOCUMENTS 4,674,652 A * 6/1987 Aten et al. ..... 221/3
4,695,954 A * 9/1987 Rose et al. ..... 364/413
4,748,600 A * 5/1988 Urquhart ..... 368/10
4,785,969 A * 11/1988 McLaughlin ..... 221/2
4,811,764 A * 3/1989 McLaughlin ..... 141/98
4,933,873 A * 6/1990 Kaufman et al. ..... 364/513.5
5,036,462 A * 7/1991 Kaufman et al. ..... 364/413.01
5,084,828 A * 1/1992 Kaufman et al. ..... 364/479
5,102,008 A * 4/1992 Kaufman et al. ..... 221/25
5,142,484 A * 8/1992 Kaufman et al. ..... 222/638
5,197,632 A * 3/1993 Kaufman et al. ..... 221/197
5,372,276 A * 12/1994 Daneshvar ..... 221/2
5,468,110 A * 11/1995 McDonald et al. ..... 414/273
5,522,525 A * 6/1996 McLaughlin et al. ..... 221/4
5,582,323 A * 12/1996 Kurtenbach ..... 221/2
5,609,268 A * 3/1997 Shaw ..... 221/2
5,755,357 A * 5/1998 Orkin et al. ..... 221/82
5,809,997 A * 9/1998 Wolf ..... 128/200.23
5,810,061 A * 9/1998 Yuyama ..... 141/129
5,839,836 A * 11/1998 Yuyama et al. ..... 400/62
5,868,135 A * 2/1999 Kaufman et al. ..... 128/630
5,945,651 A * 8/1999 Chorosinski et al. ..... 235/375
5,954,641 A * 9/1999 Kehr et al. ..... 600/300
5,988,858 A * 11/1999 Yuyama et al. ..... 364/478.18
6,006,947 A * 12/1999 Kano ..... 221/11
6,249,717 B1 * 6/2001 Nicholson et al. ..... 700/241
6,304,797 B1 * 10/2001 Shusterman ..... 700/243

FOREIGN PATENT DOCUMENTS

JP 9-51922 A * 2/1997 ..... G06F/19/00

OTHER PUBLICATIONS

Computer Translation of published Japanese Patent Application—Yuyama 9–51922.*

* cited by examiner

*Primary Examiner*—Donald P. Walsh
*Assistant Examiner*—Michael E. Butler
(74) *Attorney, Agent, or Firm*—Coudert Brothers LLP

(57) ABSTRACT

A medication dispensing cassette and related apparatus for controlling and monitoring of dispensing of oral medications is disclosed. The cassette comprises at least one continuous track having a plurality of receptacles for medication, a microprocessor to monitor and effect any movement of the continuous track and to control release of medication according to a predetermined schedule and for monitoring such release and optionally, a communication system for transmission of data on release of medication to a remote location. The remote location may be a data management system in communication with at least one of a physician's office, a hospital, a pharmacy, an insurance company, a research organization or an individual. The medication may be in the form of a pill, a powder or a liquid. The apparatus facilitates patient education with respect to the medication through display of information, and optionally as well as support and transfer data from peripheral devices e.g. blood pressure, temperature and cardiac monitors.

17 Claims, 11 Drawing Sheets

APPARATUS FOR CONTROLLING AND MONITORING OF DISPENSING OF ORAL MEDICATIONS

This application is a division of Ser. No. 09/083,832 filed May 22, 1998 now abandoned.

FIELD OF THE INVENTION

The present invention is directed to apparatus for controlling and monitoring of the dispensing of oral medications, specifically medications in the form of pills or containers of medication in powder or liquid form. The apparatus reminds the patient that medication has to be taken, provides information about the drug and further provides a monitoring function for physicians, pharmacies or other interested parties with respect to the compliance by the patient in the taking of the medication. The apparatus also has the capability of receiving data from portable monitoring devices e.g. electrocardiogram or blood pressure devices, and transferring that data e.g. to health care centres.

BACKGROUND TO THE INVENTION

The common procedure with respect to medications is for the physician to issue a prescription, which is subsequently filled by a pharmacy. The patient is then required to take the medication in the manner that has been prescribed by the physician. The patient may be taking the medication in their own residence, but in other circumstances they may be residing in a multiple residence or in an institution. In some circumstances, the patient will have a family member or a friend to assist and/or remind them in the taking of the medication. In other instances, the patient may not be willing to involve such a person or may live alone or merely wish to be solely responsible for the taking of the medication at the prescribed times.

It is believed that more than 50% of persons prescribed medications (drugs) for medical reasons do not take those medications as directed. While such non-compliance can be due to unacceptable side-effects or to lack of trust in the prescription or the prescriber, more commonly failure to take medication is due to simple forgetfulness or to inadequate knowledge of how and why the medication is to be taken. It is also well known that the rate of compliance declines as the number of medications and the number of times medications must be taken each day increases. Thus the sickest, who need the medications the most, are the least likely to take them correctly. Among the elderly, who are the largest consumers of medication and medical services, these problems are compounded by memory impairment, difficulties with vision, tremor and poor manual dexterity, such that labels cannot be read, vials opened or small tablets removed. Missed doses or inadvertant overdoses, even to the point of toxicity, are common.

Frequently physicians do not recognize that compliance is poor, and mistakenly attribute failure to improve to inadequacy of drug dose, wrong drug type or incorrect diagnosis. The physician may then erroneously increase the dose, add a supplementary drug, switch to a new (and often more toxic or expensive) medication, order additional medical tests or even hospitalize the patient. The costs of these unnecessary procedures and treatments run into billions of dollars per year, and much avoidable suffering is endured by the sick.

Electronic devices have been developed that may be programmed and which will beep or flash at appropriate times. Containers with microelectronic recording devices to record the opening of the container are also known.

Alternatively, packaging methods may be used to assist in the taking of the medication, especially when a particular sequence of medications is required, for example in birth control where the type of medication is varied over the month.

SUMMARY OF THE INVENTION

An apparatus has now been found that is capable of both controlling the dispensing of the medication and monitoring the dispensing of the medication by a number of persons, and of providing drug information.

Accordingly, the present invention provides a medication dispensing cassette comprising:

a) a housing;

b) at least one continuous track having a plurality of receptacles for medication, each receptacle accommodating one dosage of said medication, said track being within said housing;

c) a drive mechanism for said continuous track; and optionally d) a data storage system capable of storing data on a least one of name of patient, medication being dispensed, expiry date of medication, time for dispensing of medication, medication dosage and information pertaining to use of medication.

In a preferred embodiment of the cassette of the invention, the medication is in the form of a pill, a powder or a liquid, the powder or liquid preferably being in a container, the receptacles being of a size to accommodate such medication.

In another embodiment, at least some receptacles have more than one medication, all of which are to be dispensed at the same time.

The present invention further provides a medication dispensing apparatus, comprising:

a) a medication dispensing cassette having a housing, at least one continuous track having a plurality of receptacles for said medication, each receptacle accommodating one dosage of said medication, said continuous track being within said housing, a drive mechanism for said continuous track, and optionally a data storage system capable of storing data on a least one of name of patient, medication being dispensed, expiry date of medication, time for dispensing of medication, medication dosage and information pertaining to use of medication;

b) a holder for said cassette, said holder having a microprocessor to monitor and effect movement of said continuous track in said cassette using said drive mechanism, said microprocessor further monitoring said release and controlling release of said medication according to a predetermined schedule including to a programme in the microprocessor or down-loaded from the data storage system of the cassette; and c) an electrical supply for said microprocessor.

In a preferred embodiment of the medication dispensing apparatus of the invention, the holder further comprises a communication system for transmission of data relating to release of medication to a remote location.

In another embodiment, the microprocessor retains and provides for display of drug information.

In a further embodiment, the controller is adapted to receive data from a peripheral device e.g. an electrocardiograph or blood pressure monitor, and distribute said data to a remote location, the holder having communication means to communicate data from the controller to the remote location and to receive data from the remote location.

In yet another embodiment, the controller is re-programmable with data received from the remote location.

In addition, the present invention provides a system for dispensing oral medication to a patient, said system comprising:

a) a dispenser for said medication;

b) a controller for said dispenser, said controller monitoring dispensing of medication from said dispenser and comparing said dispensing of medication with a predetermined schedule for dispensing of said medication;

c) a data management system interconnected with said controller, said data management system receiving input from said controller on compliance with removal of the medication from said dispenser according to said predetermined schedule, said data management system further communicating information on dispensing of said medication to a remote location.

In a preferred embodiment of the system, the data management system is remote from said controller, especially a centralized data management system interconnected with a plurality of controllers.

In further embodiments, the remote location to which the data management system communicates information on dispensing of said medication is at least one of a physician's office, a pharmacy, a hospital, an insurance company, a senior's residence monitoring office or an individual, especially an individual who is a friend of or related to said patient.

In another embodiment, the medication is in the form of a pill, a powder or a liquid, the powder or liquid preferably being in a container.

In yet another embodiment, at least some receptacles have more than one medication, all of which are to be dispensed at the same time.

BRIEF DESCRIPTION OF THE DRAWINGS

The present invention is illustrated by the embodiments shown in the drawings, in which.

DETAILED DESCRIPTION OF THE INVENTION

Figure 1:
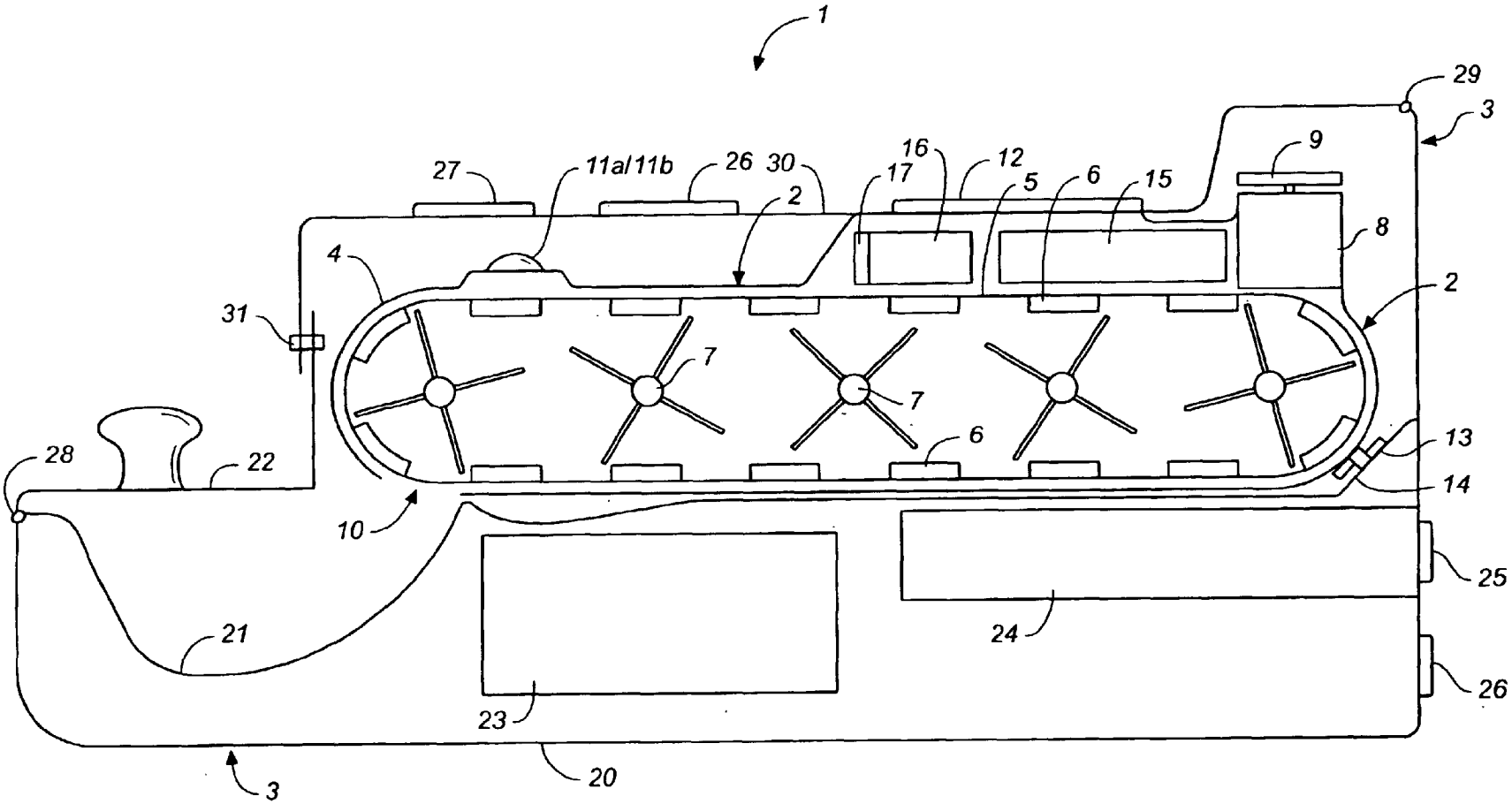
FIG. 1 is a schematic representation of a section view of a cassette in a holder.

FIG. 1 shows a cassette holder, generally indicated by 1. Cassette holder 1 has a cassette 2 and a holder 3. Cassette 2 is located within holder 3, but is removable therefrom.

Cassette 2 has cassette housing 4 in which is located continuous track 5. Continuous track 5 has a plurality of receptacles 6. Receptacles 6 are intended to contain the medication, and would be of an appropriate size and shape. However, the embodiment of FIG. 1 is particularly intended to contain medication in the form of a pill.

Continuous track 5 is driven by track drive wheels 7, which are shown as being spiked wheels that contact continuous track 5 for the purpose of causing movement of continuous track 5. Continuous track 5 as shown in FIG. 1 is constructed as a continuous band bendable about the inner sited trackwheels such as the drive trackwheels 7. However, it is understood that other drive mechanisms could be used, for instance track drive wheels 7 could be replaced with an internal track mechanism that is driven by wheels and utilizes a continuous drive belt within continuous track 5, especially to facilitate loading of the medication, especially pills, into the cassette.

Continuous track 5 is driven by drive mechanism 8. Drive mechanism 8 is an electrical drive mechanism, with the means for driving continuous track 5 not being shown. In the embodiment shown, drive mechanism 8 additionally has optional manual drive wheel 9, which may be used to manually move the position of continuous track 5. A cassette with manual drive wheel 9 is particularly intended to be capable of functioning independently of the cassette holder described herein. Cassettes not intended to function independently would normally lack manual drive wheel 9. One or more cassettes in a holder (see FIG. 2) may be intended to function independently while other cassettes are not.

Cassette housing 4 has pill dispensing port 10 located therein, at a location above pill tray 21 of holder housing 20. Independently functioning cassette 2 further has pill release buttons 11*a* and 11*b*, which may be in the form of both a button for release of pills as well as a light indicating that such release is required. Cassettes not intended to function independently would normally lack these buttons.

All embodiments of cassette 2 have electronic contacts 13 and 14. Electronic contacts 13 and 14 would normally be connected with controller 23 in holder housing 20.

Holder housing 20 has pill tray 21 therein for receiving pills dispensed from cassette 2 through pill dispensing port 10. Holder housing 20 has lid 22 thereon, shown with a child-proof release handle, and which is attached to holder housing 20 at hinge 28. Lid 22 is located above pill tray 21, and is openable for removal of pills from pill tray 21. It is to be understood that lid 22 is optional, but in preferred embodiments is intended to be a child-proof lid.

Holder housing 20 further contains controller 23 and battery pack 24. Peripheral port 25 is intended for connection of a peripheral device to the controller e.g. a blood pressure monitoring apparatus or electrocardiograph with microprocessor, so that physiological data of the patient, such as blood pressure, temperature or heart rhythm, could be transmitted to the data management system. Controller 23 would be connected through electronic contacts 13 and 14 into cassette 2, by means that are not shown. In preferred embodiments, controller 23 is further connected to remote locations, as discussed below. Holder housing 20 has speaker 26 located on the upper surface, as well as light button 27. Speaker 26 and light button 27 are located on holder top 30 which is connected to holder housing 20 at top hinge 29. Display panel 12 is located on the upper surface of holder housing 20.

While the embodiment of FIG. 1 shows one continuous track in cassette 2, it is to be understood that more than one continuous track e.g. two or more continuous tracks could be located within cassette 2, as discussed below.

Holder top 30 is shown as having lock 31 connecting holder top 30 to holder housing 20. Lock 31 is intended to restrict access to medication within cassette holder 1.

Holder top 30 could also have buttons (not shown) that could be used by a patient to advance or retard the time of dispensing of medication. For instance, if social or other activities should make it desirable to take a medication before or after the normal time for taking the medication, the patient could press an "early" or "late" button to advance or retard the time of dispensing. For instance, the pressing of a button could cause the controller to alter the dispensing of the medication by a pre-determined period of time e.g. fifteen minutes for each push of the button. In addition, the holder could be provided with a "not taken" button that would permit the patient to terminate an alarm or other reminder signal alerting the patient to the requirement to take medication, thereby effectively refusing the medication at that time. It is understood that such early or late taking of the medication or refusal to take medication would be recorded as described herein, and that the resultant record would be accessible to a physician or other person in assessing benefits of the medication and reason for refusal to take medication. The record could thus be used in evaluating the effects of the medication and possible changes to overcome problems e.g. side effects.

The independently functioning cassette would have cassette battery 15, which is intended to power the cassette when the cassette is removed from the holder housing. In addition, cassette 2 has cassette microprocessor 16, which is intended to record the operation of cassette 2, as well as control its operation, when cassette 2 is removed from holder housing 20. Cassette microprocessor 16 may also have a battery 17 associated therewith, shown in FIG. 2. Non-independently functioning cassettes do not have battery 15. Such cassettes are provided with a microprocessor capable of retaining data in a memory e.g. data such as name of medication, time for dispensing medication, medication dosage, how the medication is to be taken e.g. with food, and other information e.g. expiry date and name of the patient.

In FIG. 1, and elsewhere, housing 20 has been shown as locating cassette 2 in a horizontal position. It is understood that cassette 2 could be in a vertical or other position, with appropriate changes in some features e.g. receptacles 6, of the cassette.

Figure 1A:
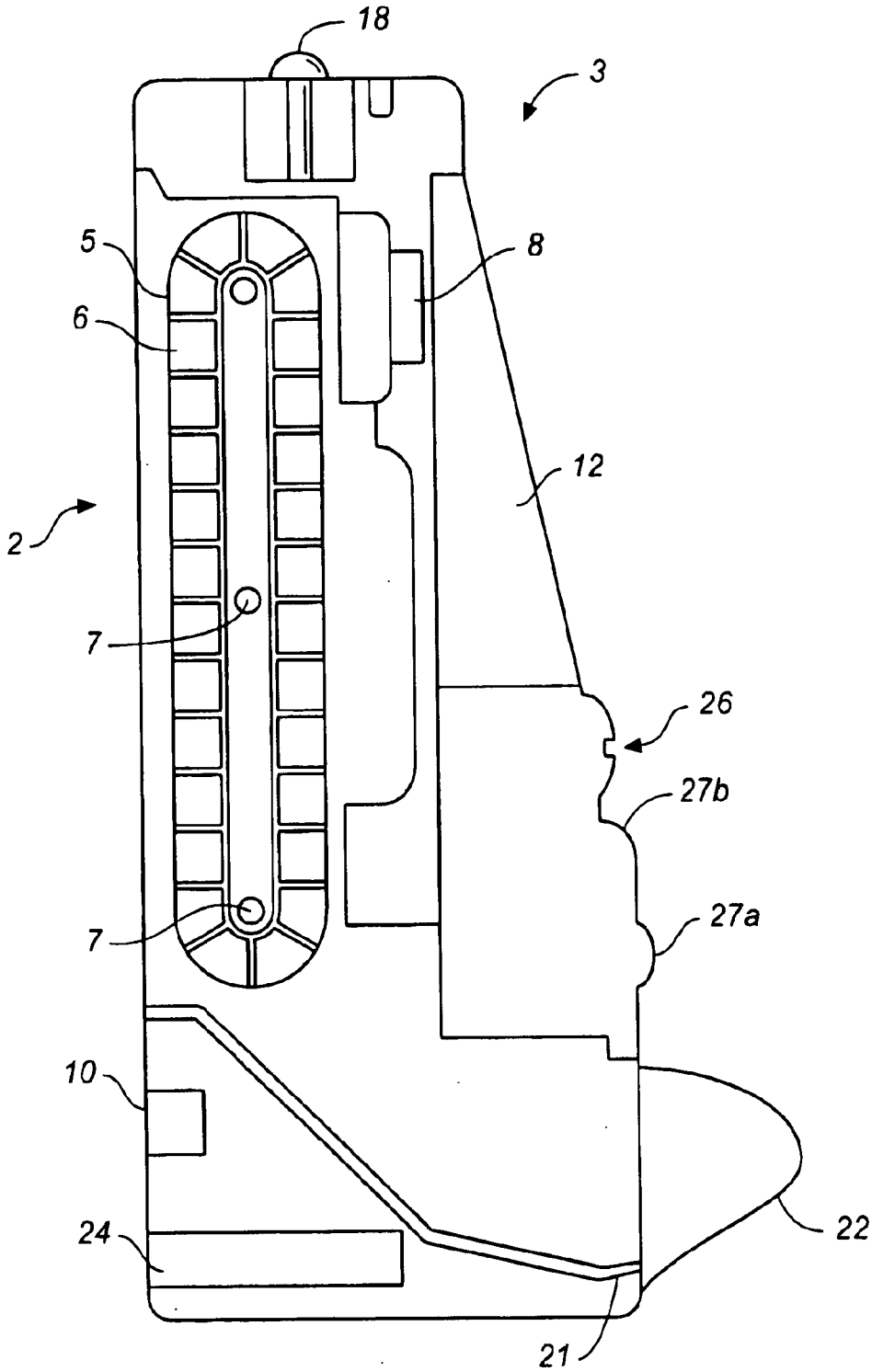
FIG. 1A is a schematic representation of a section view of an alternate embodiment of a cassette in a holder.

An embodiment of the cassette 2 in a holder 3 is shown in FIG. 1A which the holder 3 is oriented in a preferred vertical position. Cassette 2 has continuous track 5 with medication receptacles 6. Continuous track 5 is driven by track drive wheels 7, using drive mechanism 8. The housing of cassette 2 has pill dispensing port 10, leading to pill tray 21 and lid 22.

Holder 3 is shown with a handle, 18, for carrying of holder 3. On one side of holder 3 are located display panel 12, speaker 26, and buttons 27*a* and 27*b*; buttons 27*a* and 27*b* are discussed below. Holder 3 also has peripheral part 25 and battery pack 24.

Figure 1B:
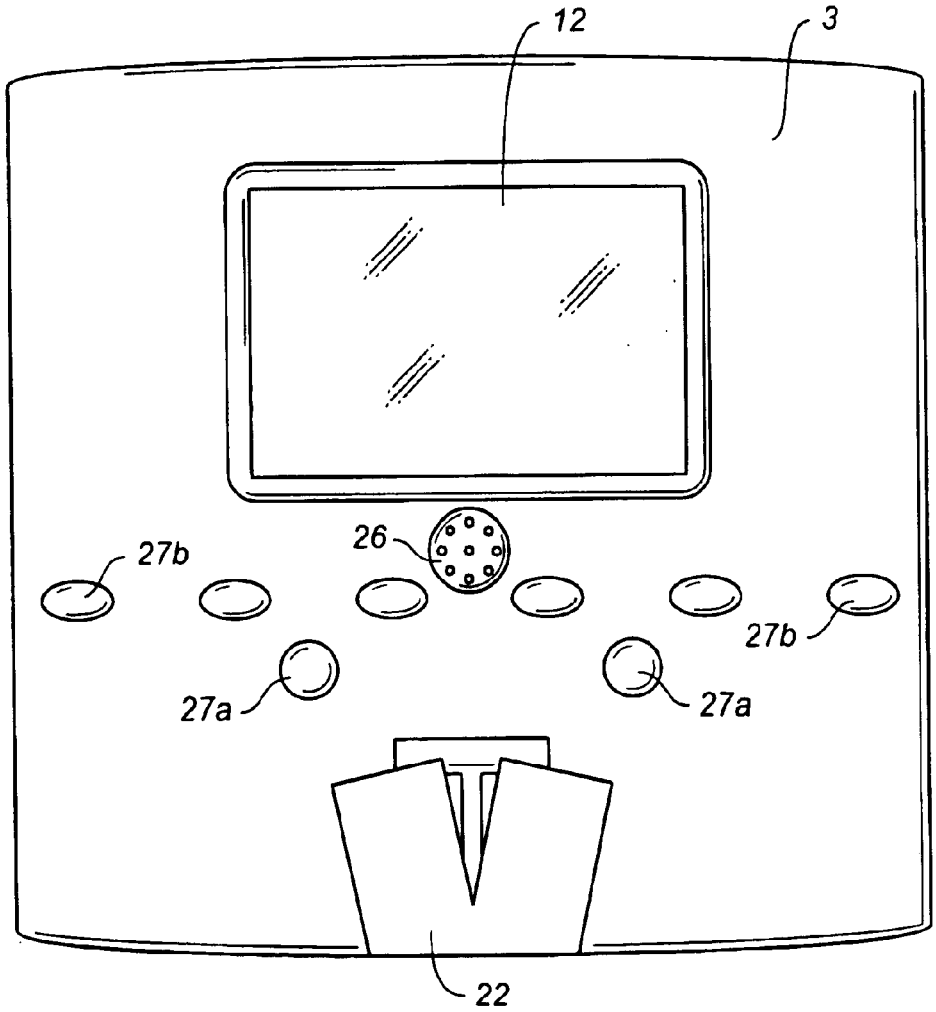
FIG. 1B is a schematic representation of a front view of the embodiment of FIG. 1A.

FIG. 1B shows a front view of the embodiment of FIG. 1A. Holder 3 has a display panel 12 on which information on the name, uses and effects of the medication, or other pertinent information, may be displayed. Holder 3 also has a speaker 26, buttons 27*a* and 27*b*, and lid 22 of the pill dispensing mechanism. Buttons 27*a* are intended to permit a user to dispense medications earlier or later than the prescribed time, and thus could be identified with "E" and "L", respectively. It is intended that the use of the "E" or "L" buttons would be recorded in the microprocessor. The six buttons 27*b* are the light buttons that are for dispensing of the medication from the respective cassettes. In embodiments, a button would be lit to indicate which cassette contained the medication that the patient was next scheduled to take.

Figure 1C:
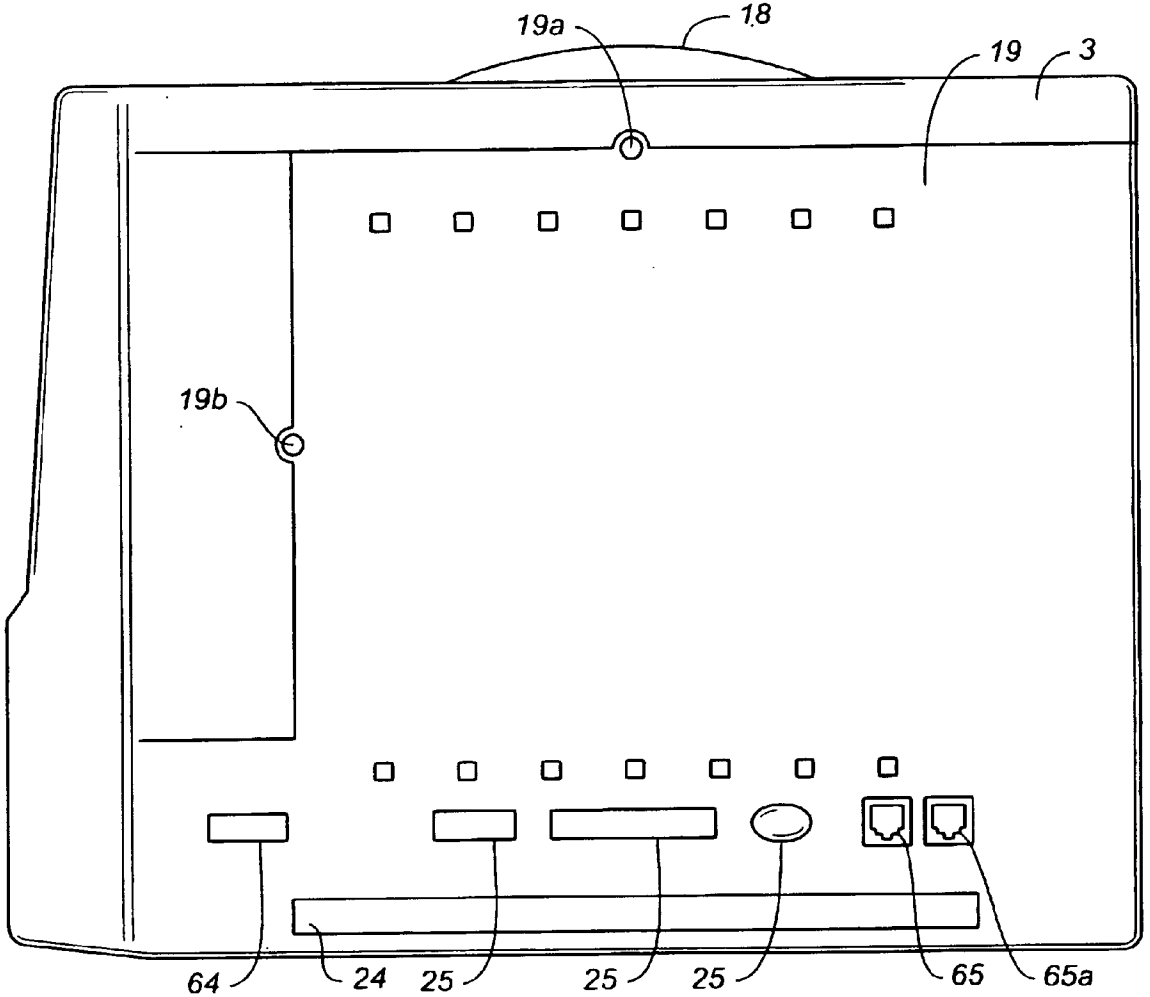
FIG. 1C is a schematic representation of a rear view of the holder of the embodiment of FIG. 1A.

FIG. 1C shows a rear view of the embodiment of FIG. 1A. Holder 3 has handle 18 and a plurality of electronic ports 25. Electronic ports 25 could be computer ports e.g. RS232 or other ports, to receive data form peripheral devices, such as EKG or blood pressure apparatus, telephone and modem ports (65, 65*a*) and current (electrical power) port 64. Slot 24 is intended for insertion of a back-up battery power source. The types of ports would be dictated by the intended functions of the particular embodiment of the unit. Holder 3 also has rear 19 with lockable door latches for regular cassettes 19*a* or portable unit 19*b*.

Figure 2:
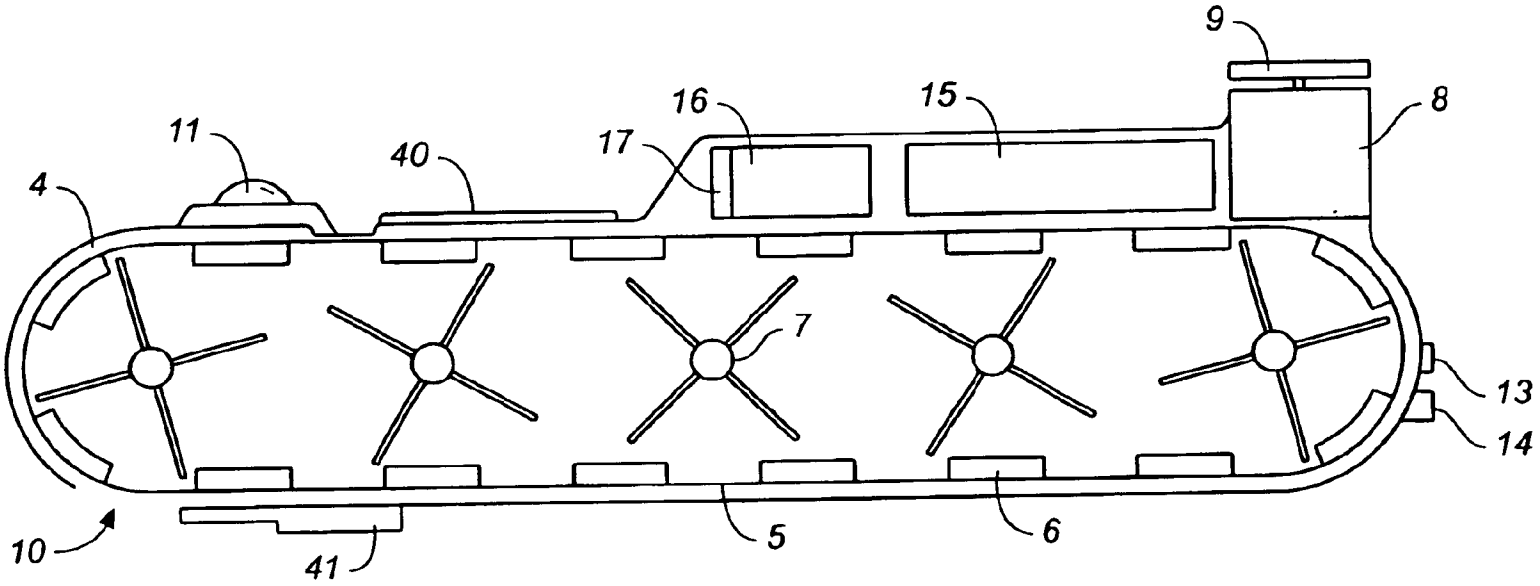
FIG. 2 is a schematic representation of a section view of a cassette for dispensing medication.

FIG. 2 shows an independently functioning cassette separated from the holder housing. Cassette 2 is shown as having continuous track 5 with pill receptacle 6, being driven by track drive wheels 7. Cassette 2 also has drive mechanism 8 and manual drive wheel 9. Cassette battery 15 is for operation of cassette 2 when separated from holder housing 20 (see FIG. 1). Microprocessor 16 has a battery 17 for operation of microprocessor 16. Cassette housing 4 encompasses cassette 2, with pill dispensing port 10 on the underside thereof. Adjacent to pill dispensing port 10 is release door 41, for use in the event of a power failure, so that dispensing pill port 10 may be opened to dispense a pill. In addition, in the embodiment shown, adjacent to pill release 11 is pill loading port 40, which is in the form of a lid which may be opened to access the interior i.e. pill receptacles 6.

Figure 2A:
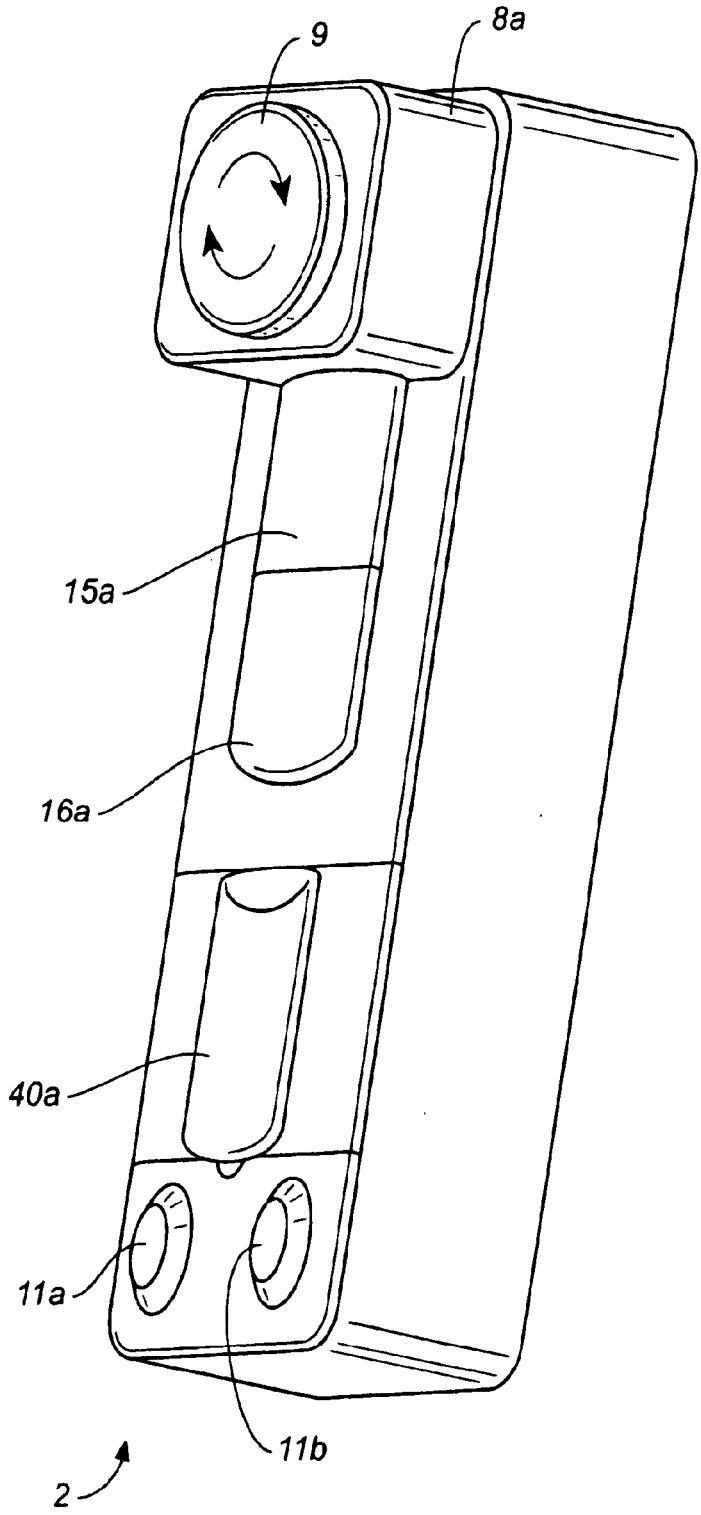
FIG. 2A is a schematic representation of a perspective view of a cassette of FIG. 2.

FIG. 2A shows a perspective view of an embodiment of a cassette. Cassette 2 has manual drive wheel 9 that is located on the housing 8*a* over drive mechanism 8 (not shown). Cassette 2 further has housing 15*a* over battery 15 and housing 16*a* over microprocessor 16. Pill loading housing 40*a* covers pill loading port 40. In addition, cassette 2 is shown with pill release buttons 11*a* and 11*b*.

Figure 3:
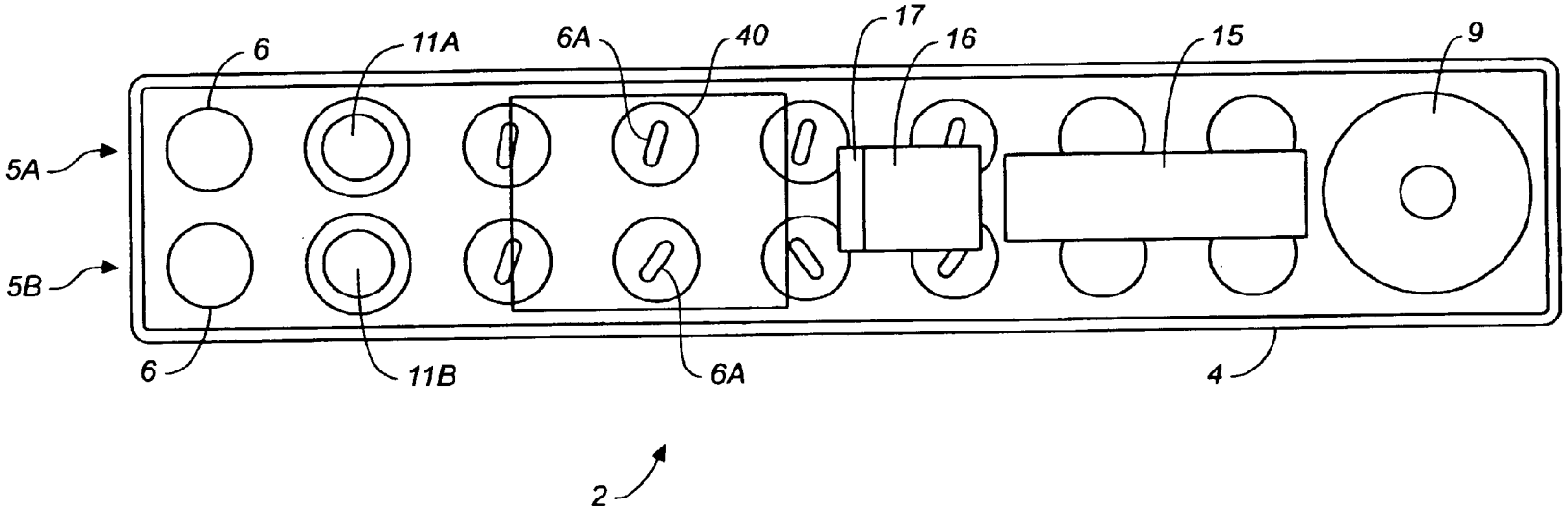
FIG. 3 is a schematic representation of a plan view of a cassette for dispensing medication.

FIG. 3 shows a plan view of cassette 2, in which housing 4 is assumed to be a clear plastic housing. Cassette 2 has manual drive wheel 9 adjacent to cassette battery 15, cassette microprocessor 16 and microprocessor battery 17. Cassette 2 also has pill loading port 40. The embodiment shown in FIG. 3 has two continuous tracks, identified as 5A and 5B. It is understood that cassette 2 could have one track, or it could have two or more tracks depending on the pills that are to be dispensed for the patient. Tracks 5A and 5B may each contain more than one type of medication, and microprocessor 16 could have the capability of advancing and/or withdrawing tracks 5A and 5B by variable distances, so that the correct medication may be dispensed at the appropriate time. Continuous tracks 5A and 5B have corresponding pill release buttons 11A and 11B, which become illuminated and thereby signal that it is time to take medication. Additionally, this cassette may be provided with a tone generator to audibly signal that it is time to take medication or a vibration generator to signal medication time. FIG. 3 shows pill receptacles 6, some of which have medication 6A in pill form.

Figure 4:
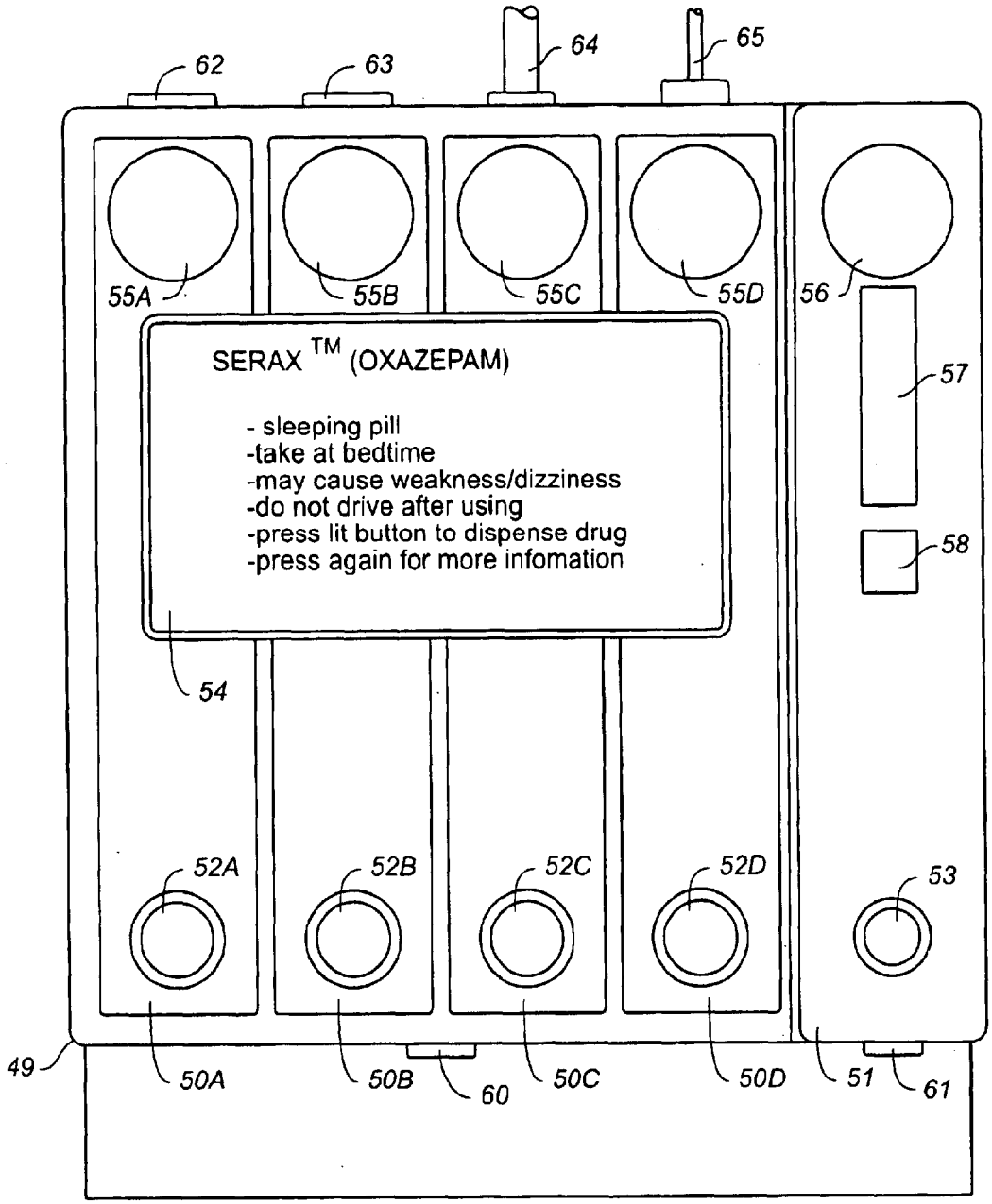
FIG. 4 is a schematic representation of a plan view of a system of cassettes.

FIG. 4 shows a housing 49 having a plurality of cassettes, indicated by 50A, 50B, 50C and 50D, as well as a portable cassette 51. Cassettes 50A–D are actuated by release buttons 52A, 52B, 52C and 52D respectively, that would include lights and which are built into the lid of the cassette holder. These buttons could also be made to serve the additional function of providing further drug information e.g. by pressing on the button a second time to activate the microprocessor to show the further information on the screen. Portable cassette 51 is also linked with release button 53, which would control cassette 51 if it is used while seated in housing 49. Portable cassette 51 would be controlled by release buttons 11*a* and 11*b* (not shown in FIG. 4) when used while separated from housing 49. Housing 49 has screen 54 thereon, which is shown as having a message to a patient. The message displayed could include drug name, purpose, side effects and instructions for use as well as more detailed information, if desired, e.g. common drug interactions. Portable cassette 51 has manual drive wheel 56, battery 57 and microprocessor 58. Housing 49 has release mechanism 60, for release of cassettes 50A–D.

Release mechanism 61 effects release of cassette 51. Housing 49 also has peripheral ports 62 and 63, power supply cord 64 and modem cord 65.

Figure 5:
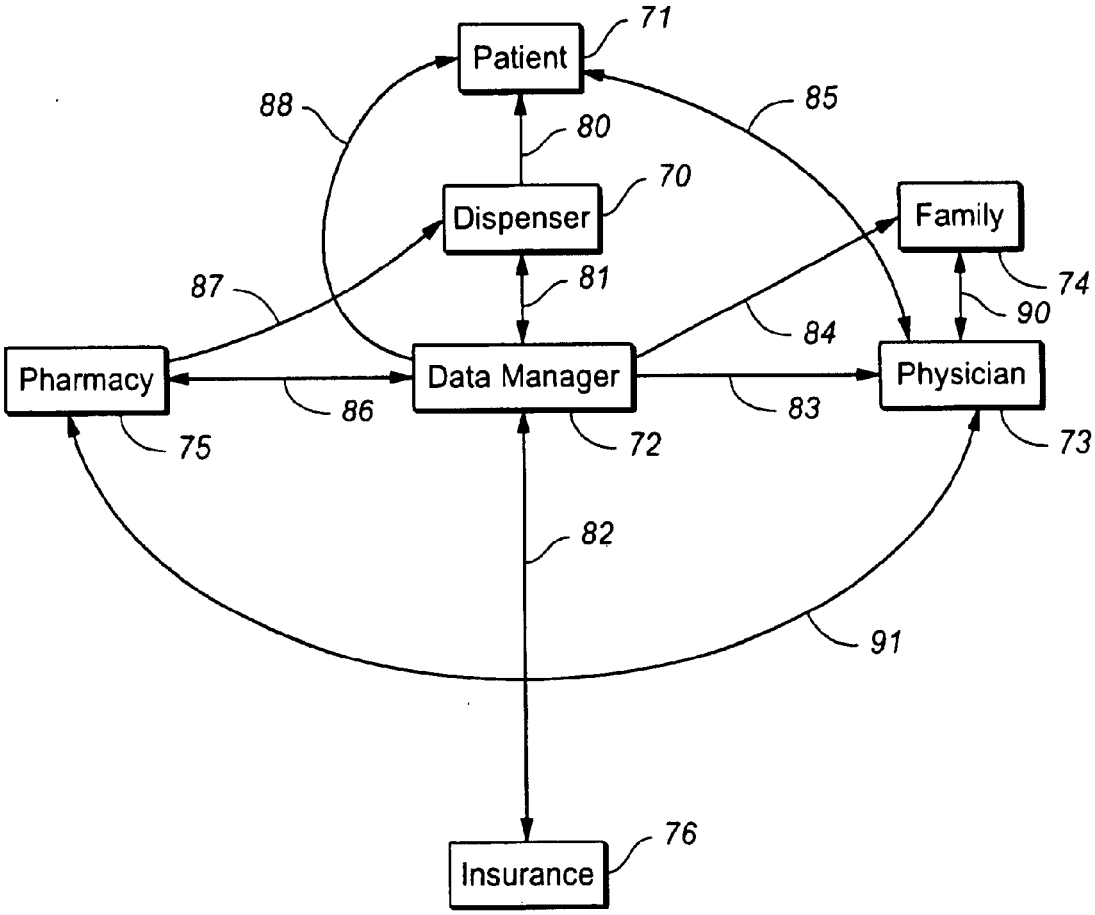
FIG. 5 is a schematic representation of a system for dispensing and monitoring dispensing of medications, and for communicating information of said dispensing.

FIG. 5 shows a system for the interface between a drug dispensing unit as represented by dispenser 70 with patient 71, data manager system 72 and pharmacy 75. Data manager system 72 also interfaces with physician 73, family 74 and insurance company 76. Dispenser 70 interfaces with patient 71 through interface 80 and with data manager system 72 through interface cable 81. In addition, dispenser 70 is shown as interfacing with pharmacy 75 through data manager system 72 and interface cable 87. Pharmacy 75 also interfaces with data manager system 72 through interface cable 86; it is understood that interface cables could represent facsimile, telephone or internet connections. In addition, data manager system 72 interfaces with insurance company 76 through interface cable 82, with physician 73 through interface cable 83 with family 74 through interface cable 84 and/or with patient 71 through interface cable 88. It is to be understood that interface via cables 84 and 88 could also be telephone voice communication. Physician 73 could interface with family 74 through interface cable 90, with patient 71 through interface cable 85 or by voice telephone, but would normally do so by face-to-face conversations. Physician 73 could also interface with patient 71 via the data manager (cables 81 and 83) and with the pharmacy via cable 91 (voice telephone). Data passing bidirectionally between patient, pharmacy, physician and insurer may be relayed by the data manager. Pharmacist, physician or insurer could, for example, pass text or graphic images to the patient via the data manager, which could then appear on the dispenser screen.

Figure 6:
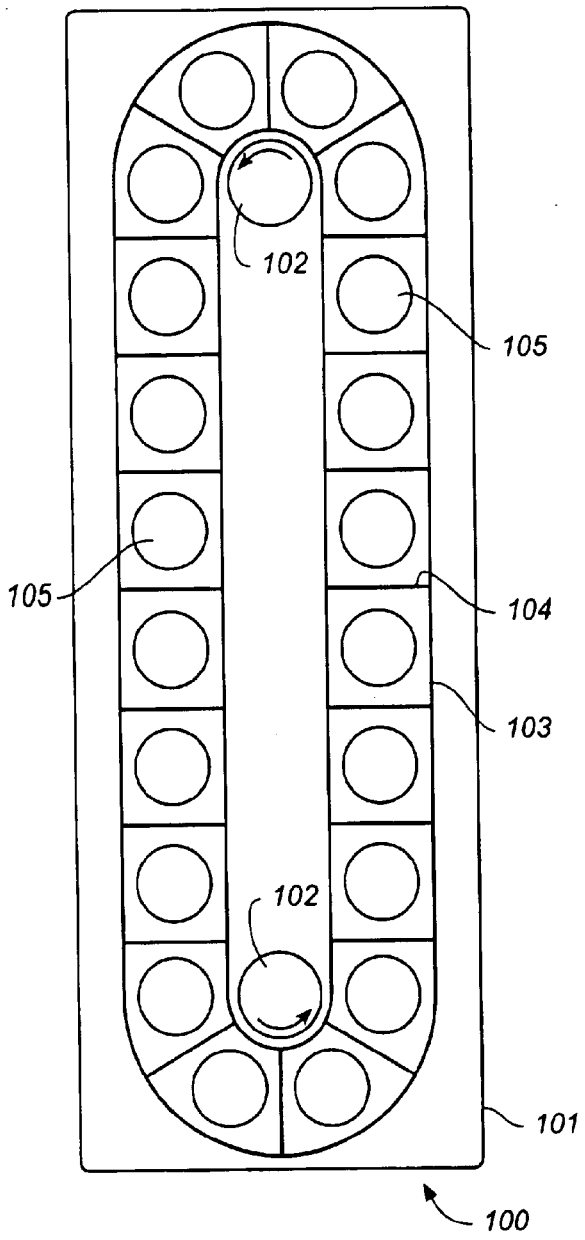
FIG. 6 is a schematic representation of a plan view of a cassette for dispensing powder or liquid medication.

FIG. 6 shows an alternate embodiment of a cassette, generally indicated by 100. Cassette 100 has a holder 101 having continuous track 103. Continuous track 103 has a plurality of dividers 104 spaced in a sequential manner around the track. Continuous track 103 is driven by drive wheels 102, located at opposed ends of housing 101 and within continuous track 103. Each of compartments 103 contains a medication container 105, which is shown in side view in FIG. 7.

Figure 7:
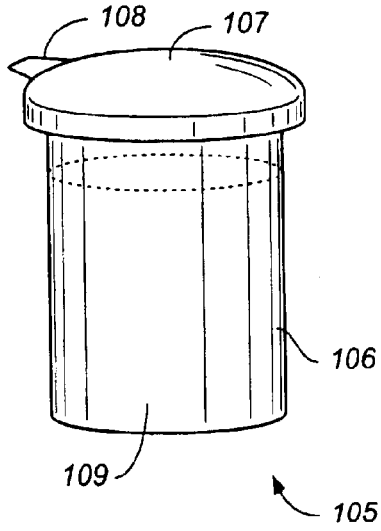
FIG. 7 is a schematic representation of a side view of a container for powder or liquid medication.

FIG. 7 shows container 105 having base section 106 and lid 107. Lid 107 is shown as having a tab 108, which in one embodiment would be a tab of a removable foil covering lid 107. Alternatively, container 105 could be a child-proof container of the type that is known. Container 105 contains a powder or liquid medication 109.

Figure 8:
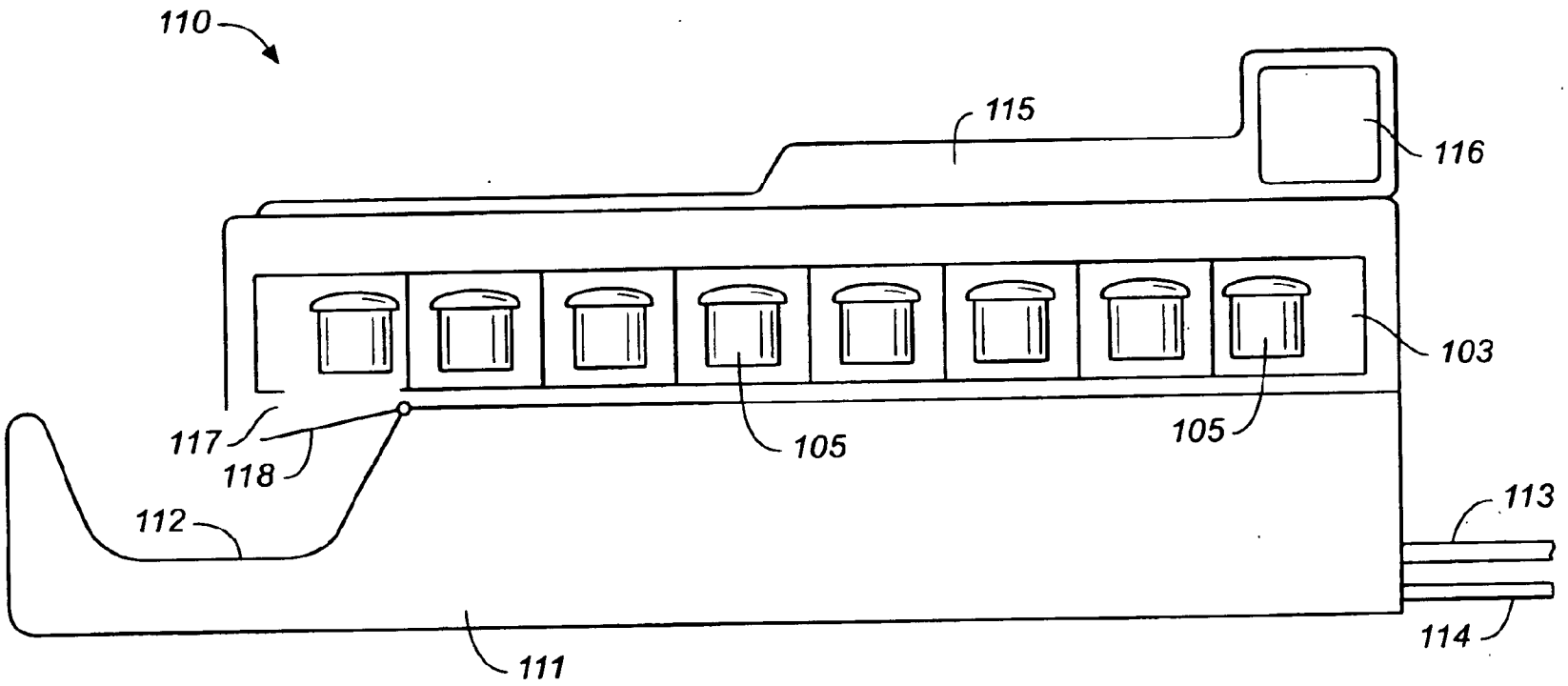
FIG. 8 is a schematic representation of a side view of the cassette of FIG. 6 in a holder.

FIG. 8 shows an embodiment of powder and liquid medication dispensing apparatus, generally shown by 110. Apparatus 110 has housing 111 which has medication tray 112 at one end thereof and cables 113 and 114 at the opposed end. Cables 113 and 114 could be power and communication cables. Housing 111 further has lid 115 at the top thereof, which encloses motor 116 for driving continuous track 103. Lid 115 covers continuous track 103, which has medication dispensing containers 105. Housing 111 further has a port 117 for dispensing of containers 105. Port 117 is closed by movable door 118.

For operation of the pill and capsule embodiment of the apparatus, as shown in FIG. 1, pill receptacles 6 are loaded with the particular oral medication in pill form that is to be taken by a patient. In versions of the cassette that have more than one continuous track 5, it is possible that different medications would be loaded into each track of the cassette.

The medication is conveniently loaded through lid 40 (FIG. 2) although other means of loading cassette 2 could be provided. While the patient could load the cassette, it is particularly intended that the cassette would be taken to a pharmacy or other location for loading by a pharmacist or other qualified person. The loading is conveniently accomplished by inserting pills through pill loading port 40. Microprocessor 16 is programmed by the pharmacist at the time of the loading of the pills into the cassette. Cassettes are intended to be interchangeable with different housing but the micro processor would maintain a record of all medications that were ever loaded, to avoid contamination with drug residues to which the patient might be allergic.

In the embodiment shown in FIG. 1, cassette 2 is located in holder housing 20. Controller 23 which would, for example, be programmed with information on the patient's meal times and bedtime, interacts with the drug information in microprocessor 16 to generate a schedule for dispensing the medication. For instance, controller 23 could be programmed so that cassette 2 dispensed a pill one hour before mealtime or two hours after a meal, or at other times according to the instructions of the physician. At the time for the dosage, controller 23 would light pill release light 27, (27*b* in FIG. 1B) sound an alarm and/or communicate with pre-recorded verbal instructions through speaker 26. Multiple means of alerting a patient would likely be used, to facilitate use by both visually impaired and hearing impaired persons. Optionally, radio frequency operation could activate a wrist-worn vibrator, or other device, to alert hearing-impaired patients of the need to take medication. Alternatively, microprocessor 23 could turn on a connected television and display instructions to take medication by overlaying the instructions on the screen. At the time alert signal is generated, the name of the drug and other patient information would appear on screen 12.

The patient would press pill release 27 (27*b* in FIG. 1B) so that the medication was dispensed through pill dispensing port 10 into pill tray 21 from which the pill could be removed by opening lid 22. The dispensing of the pill i.e. the pushing of pill release 27, (27*b* in FIG. 1B) would be noted by controller 23 which would record in its memory that the pill had been taken and reprogram to notify the patient at the appropriate time for the next medication. Controller 23 could cause advancement of continuous track 5 at an appropriate time so that the next pill was properly located. If the disposing button 27 (27*b* in FIG. 1B) is not pressed immediately, the alerting signal would preferably continue, intermittently for a predetermined period of time. After button 27 (27*b* in FIG. 1B) is pressed the medication is dispensed. If button 27 (27*b* in FIG. 1B) is pressed at times other than the time for medication dispensing, information relating to the medication contained in that cassette would be displayed on screen 12. The patient would have the option of terminating the alert signal and refusing the medication by pressing a "not taken" button (not shown). If several medications are to be dispensed at the same time, microprocessor 23 can be programmed either to deliver all the medications with a single button press, with drug name and information for each drug appearing sequentially upon screen 12 or to require a separate button push for each medication, with the drug information appearing as the buttons are pressed.

Some drugs are to be used only when necessary. The microprocessor could be programmed to deliver the appropriate dose of such drugs whenever the patient presses button 27 (27*b* in FIG. 1B). The time interval between subsequent doses of such drugs and maximum number of doses permitted, for example not more often than every 4 hours for a maximum of 4 doses per 24 hours, would be programmed into microprocessor 23. For such optional drugs, the usual drug information appearing on screen 12 would be supplemented by instructions regarding the use of these drugs and data regarding the number of doses already consumed that day.

If the patient does not respond by pressing button or the "not taken" button by the end of the first set of alerting signals, microprocessor 23 notifies the data manager through cable 81 (FIG. 5). The data manager then contacts the patient by voice telephone (or internet connection with voice capability) using either a recorded message, live operator or both in sequence to remind the patient of the importance of taking the medication. The data manager may optionally connect the patient with a pharmacist, physician or nurse for further discussion.

In one of the manifestations of housing 20 (not shown), speaker 26 may be linked with an internal speaker hone to allow direct voice communication between the patient and the data manager.

If the patient presses the "not taken" button, a live operator will call, using the voice (or internet connection with voice capability) to confirm that the patient does not wish to take the medication and to establish and record the reason for this decision.

If the frequency of non-compliance or refused doses exceeds a predetermined threshold, which might be either a single or multiple missed or refused doses, the patient's family or friend can be notified. In addition, the data manager may provide summary compliance reports to the patient, family, pharmacy, physician and insurance company at regular intervals.

In the event of an AC power failure, cassette 2 could be powered by battery pack 24, which would be recharged continuously.

In the event that the portable version of cassette 2 needed to be removed from holder housing 20, the medication track of cassette 2 would be advanced by motor 8, which is powered by cassette battery 15. Cassette 2 is controlled by microprocessor 16, which is powered by microprocessor battery 17. Microprocessor 16 would perform a similar function to controller 23, to the extent of alerting the patient at the appropriate time for the taking of the medication providing for the use of optional medications and recording that the medication had been taken. When cassette 2 was returned to holder housing 20, microprocessor 16 would up-date controller 23, so that controller 23 had a full record of the taking of the medication.

As noted above, embodiments of the invention in which there are two tracks, e.g. as illustrated in FIG. 3, or multiple tracks, as illustrated in FIG. 4, the controller could be programmed so that different medications could be taken at different times and on different time schedules. It is possible to program the controller of FIG. 3 so that medication was dispensed from track 5A and 5B simultaneously or at different times. Tracks 5A and 5B could each contain more than one type of medication, and controller 16 could be programmed to advance or withdraw each track the appropriate distance to dispense the correct medication at the appropriate time.

In another version of the device for the cognitively impaired or for those uncomfortable with complicated controls, buttons 27*b* could be replaced by a single button. When a drug is to be dispensed, basic drug information (drug name, intended use and short list of side effects) automatically appear on screen 12, or, if the number of lines of text is too large for simultaneous display, on a slowly scrolling screen. A single button press will dispense all medications to be taken at that time. In this version of the device the names and uses of drugs to be taken at the patients option, that is those which are to be taken only "when necessary" will sequentially appear on the screen at 10 second intervals. A button press at the time the drug name is displayed will dispense the correct "when necessary" medication within the time and frequency of use instructions given by the physician and programmed into the microprocessor.

The embodiment of FIGS. 6–8 particularly shows the dispensing of medication in the form of powder or liquid i.e. medication contained within containers. Cassette 100 shown in FIG. 6 would operate in the same manner as the cassettes described above. However, cassette 100 would normally be of larger dimensions than the cassette described previously, because container 105 is substantially larger than a pill.

Containers 105 conveniently have foil tops that may be peeled off to release the medication. However alternative means of enclosing the medication within the container may be used. In the embodiment of FIGS. 6–8, continuous track 103 is rotated in the manner described above with respect to the continuous track, such that a container may be dispensed into tray 112.

The continuous track of the cassette of FIGS. 6–8 could run in the same directions as the continuous track described previously, but in preferred embodiments would operate at 90° angles to the tracks described above, or at other angles, with the housing being designed to accept these alternative embodiments of the cassette.

The system illustrated in FIG. 4 could be programmed so that different persons in the same household could have their own medicines dispensed at appropriate times for each person using the unit. In such an instance, the screen could indicate the name of the person who is to take the medication, as well as any warnings or other drug taking requirements.

The various cassettes and holder housing illustrated in the drawings are provided with appropriate locks and release mechanisms for security, especially with respect to children. However, the security could be arranged for other reasons. It is preferred that the opening of the holder housing be noted by the microprocessor or controller so that the event could be of record, particularly if a patient should elect to use greater than the prescribed amounts of medication.

In a preferred embodiment, the present invention provides a system for dispensing and monitoring the dispensing of medication to a patient. FIG. 5 shows a dispenser 70 that interfaces with a patient 71 through interface 80. This would typically be the system of dispensing pills described above in which the dispenser alerts the patient that medication is to be taken and monitors that the patient has indeed taken the medication. However, in the embodiment of the system of FIG. 5, the dispenser would then communicate, from time to time, the status of the taking of the medication by the patient another location. This would be done through interface 81, which could be in the form of a link by modem, as indicated by modem link 65 of FIG. 4.

The cassette for dispensing of the medication preferably has a data storage system e.g. a memory chip, capable of storing data on the name of the patient, the name of the medication being dispensed, the expiry date of the medication, the dispensing schedule for the medication and information pertaining to use of the medication and/or other information. The information could be displayed. Information on the patient and medication could be used to reduce any likelihood of dispensing of incorrect medications to a patient. The expiry date could be used, for example, in event of return of unused medications, for possible use by another patient, it being assumed that suitable precautions were taken to detect tampering with the medication. Information pertaining to use could include how to take the medication, possible side effects and warnings, possible interactions with other drugs, and any other pertinent information.

The data manager system would be a computer or microprocessor programmed to receive, process and communicate information. However, it would be preferred that the cassette be linked either continuously or on a frequent basis to the data manager system so that the data manager system can communicate to various other locations on the status of the taking of the medication by the patient. For instance, the data manager system could communicate e.g. through a modem or facsimile, by interface 83 to a physician 73. The physician could then note whether the patient was taking medication according to the prescribed schedule or whether the patient was taking the medication at some other times. The information would assist the physician in making decisions on whether the medication should be continued for the patient or whether there should be some alterations in the medication and/or the dosage.

The data manager system 72 could also communicate to the family of the patient, it being understood that the family could be any relative, friend, a supervisor at a senior's residence, health professional e.g. a community nurse or some such similar person undertaking to receive communications. The data management system could also report to other parties e.g. a researcher if the system were to be used to assess compliance as part of a study involving drug administration. An important purpose of the data manager system communicating to the family would be for the family to assist the patient in taking of the medication at the required times and/or enabling the family to check on the patient in the event that medication was not being taken. Thus, the patient could maintain their independence, but others would be alerted if the patient needed assistance.

The data manager system 72 could also communicate via a modem to a pharmacy on the status of the taking of the medication. The pharmacy would then be able to alert the patient either by voice telephone or via a text message displayed on the dispenser screen, that it was time for the patient to bring in the cassette for replacement of medication. The pharmacy could re-load the cassette and re-program the controller, if necessary.

The pharmacy could also reprogram the dispenser remotely via cable 87, simultaneously informing the data manager via cable 86. It is also possible, as indicated in FIG. 5, that the cassette could communicate directly to the pharmacy through modem 65. The data manager system could also communicate to other sources e.g. insurance sources, a hospital or senior's residence monitoring office or the like, who might have an interest in the status of the taking of the medication by the patient, costs and the like.

In embodiments, on advice from a physician or pharmacist, the data manager could re-programme the controller dispense the medication according to a new schedule or in a new dosage.

The present invention provides a system with a variety of uses e.g. for the dispensing of medication to a patient on a pre-determined schedule, for educating the patient about the medication being taken and for monitoring that the patient was taking the medication. The invention also provides a system so that other interested parties, e.g. physicians, pharmacies, family or the like could monitor or be alerted as to the status of the taking of the medication.

Drug non-compliance data may be monitored in real time, if desired, and appropriate action taken. The data manager system could initiate any one or a cascade of responses to the data being received.

The data manager system could also be linked to the patient for monitoring and/or recordal of other data e.g. pulse, blood pressure or the like of the patient, by connection of peripheral devices to microprocessor 23, through peripheral port 25. The data manager could forward the data to the relevant remote sites, for instance a physician's office, hospital outpatient service or emergency room, or the like.

The apparatus of the present invention provides for controlling and monitoring of the taking of medications by patients.

What is claimed is:

1. A medication dispensing apparatus comprising:

at least one cassette having a cassette housing, at least one moving endless track within said housing, and a motor within said housing for driving said endless track, said endless track having a plurality of receptacles for medication, each receptacle accommodating one dosage of said medication, said endless track constructed as a continuous band bendable about inner sited trackwheels; and means for real-time interaction between said dispensing apparatus and a remote monitoring station.

2. The medication dispensing apparatus of claim 1 further comprising a data storage system capable of storing data on at least one of name of patient, medication being dispensed, expiry date of medication, time for dispensing of medication, medication dosage and information pertaining to use of medicine.

3. The medication dispensing apparatus of claim 2 in which the medication is in a form selected from the group consisting of a pill, a powder, and a liquid, the receptacles being of a size to accommodate the medication.

4. The medication dispensing apparatus of claim 3 in which at least one of the powder and the liquid is in a container.

5. The medication dispensing apparatus of claim 3 in which at least some receptacles are adapted to accommodate more than one medication, all of which are to be disposed at the same time.

6. The medication dispensing apparatus of claim 3 in which receptacles have a first medication and second medication, to be dispensed in sequence.

7. The mediation dispensing apparatus of claim 1 further comprising: a holder for said cassette, said holder having a microprocessor to monitor and effect movement of said continuous track in said cassette using said drive mechanism, said microprocessor further monitoring said release and controlling release of said medication according to a predetermined schedule; and an electrical supply for the microprocessor and for the drive mechanism of the cassette.

8. The mediation dispensing apparatus of claim 7 in which the cassette has a data storage system capable of storing data on at least one of name of patient, medication being dispensed, expiry date of medication, time for dispensing of medication, medication dosage and information pertaining to use of medication.

9. The mediation dispensing apparatus of claim 8 in which the predetermined schedule is programmed in the microprocessor.

10. The mediation dispensing apparatus of claim 7 in which the predetermined schedule has been down-loaded from the data storage system of the cassette.

11. The mediation dispensing apparatus of claim 7 in which the holder further comprises a communication system for transmission of data relating to release of medication to a remote location.

12. The mediation dispensing apparatus of claim 11 in which said microprocessor retains and provides for display of drug information.

13. The mediation dispensing apparatus of claim 11 in which the controller is adapted to receive data from a peripheral device and distribute said data to a remote location, said holder having communication means to communicate data from said controller to said remote location and to receive data from said remote location.

14. The mediation dispensing apparatus of claims 13 in which the controller is reprogrammable with data received from the remote location.

15. The mediation dispensing apparatus of claim 7 in which the powder or liquid is in a container.

16. The mediation dispensing apparatus of claim 7 in which at least some receptacles are adapted to accommodate more than one medication, all of which are to be dispensed at the same time.

17. The mediation dispensing apparatus of claim 11 which the controller will dispense medication at a time selected from a time earlier than the predetermined schedule and a time later than the predetermined schedule, and record said time of dispensing of the medication.

* * * * *